United States Patent [19]

Genoa

[11] 4,385,790

[45] May 31, 1983

[54] VACUUM CLEANER HOSE END ADAPTER

[75] Inventor: Joseph Genoa, Freeport, N.Y.

[73] Assignee: Atlantic Vacuum Parts Corp., Long Beach, N.Y.

[21] Appl. No.: 193,179

[22] Filed: Oct. 1, 1980

[51] Int. Cl.[3] ..... H01R 4/64

[52] U.S. Cl. ..... 339/16 R; 339/15

[58] Field of Search ..... 339/15, 16 R

[56] References Cited

U.S. PATENT DOCUMENTS 4,188,081 2/1980 Holden et al. ..... 339/15

*Primary Examiner*—Eugene F. Desmond

*Attorney, Agent, or Firm*—Frishauf, Holtz, Goodman & Woodward

[57] ABSTRACT

A vacuum cleaner hose adapter comprises a generally cylindrical housing which connects at one end to an electrified vacuum cleaner hose receptacle and which connects at the other end to a vacuum cleaner hose. An electrical contact arrangement is provided to connect with the electrified vacuum cleaner hose receptacle and to bring the power to a first electrical connector on the adapter. In use, a standard-type vacuum cleaner hose may be inserted into the adapter and the electrical power cord thereof be engaged with the electrical connector on the adapter. The adapter is then plugged into the vacuum cleaner hose receptacle for electrically contacting the electrical contacts of the vacuum cleaner hose receptacle to provide power to the electrical connector.

5 Claims, 6 Drawing Figures

VACUUM CLEANER HOSE END ADAPTER

CROSS-REFERENCE TO RELATED APPLICATION

U.S. Design application Ser. No. 161,585, filed June 20, 1980, in the name of Joseph Genoa.

BACKGROUND OF THE INVENTION

This invention relates to a vacuum cleaner hose adapter, and more particularly to such an adapter which can adapt existing vacuum cleaners with built-in electrical connectors to use standardized vacuum cleaner hoses instead of specially fabricated hoses.

In particular, the present invention is directed to a vacuum cleaner hose end adapter for adapting standardized vacuum cleaner hoses to the electrified vacuum cleaner coupling shown, for example, in U.S. Pat. No. 3,434,092. To date, the electrified hoses used with the vacuum cleaner coupling of U.S. Pat. No. 3,434,092 required specialized fittings. Such specialized hoses may not be readily available in some instances, and when available, are relatively expensive.

Therefore, the object of the invention is to provide a hose end adapter which enables a standardized, readily available and inexpensive electrified hose arrangements to be adapted to a specialized vacuum cleaner hose connection, and in particular, the specialized electrified hose receptacle of the general type shown in U.S. Pat. No. 3,434,092, the entire contents of which are incorporated herein by reference.

SUMMARY OF THE INVENTION

According to the present invention, a vacuum cleaner hose end adapter comprises a generally cylindrical housing which has means at one end thereof for lockingly engaging an electrified vacuum cleaner hose receptacle, and means at the other end thereof for engaging a vacuum cleaner hose; means at said other end of the housing defining a first electrical connector for receiving a mating electrical connector and for supplying electrical energy to the mating electrical connector; means at said one end of the housing defining a pair of electrical contact members projecting outwardly of the housing and being electrically insulated from the housing; and electrical conductors running with the housing and electrically connecting the respective electrical contact members with the electrical connector; whereby the electrical contact members extend from the housing and electrically contact mating electrical contacts within a vacuum cleaner into which the adapter is engaged for supplying electrical energy from the vacuum cleaner to the electrical connector.

In a preferred arrangement the electrical connector is a female receptacle adapted to receive a male connector from a vacuum cleaner hose.

DETAILED DESCRIPTION

Figure 2:
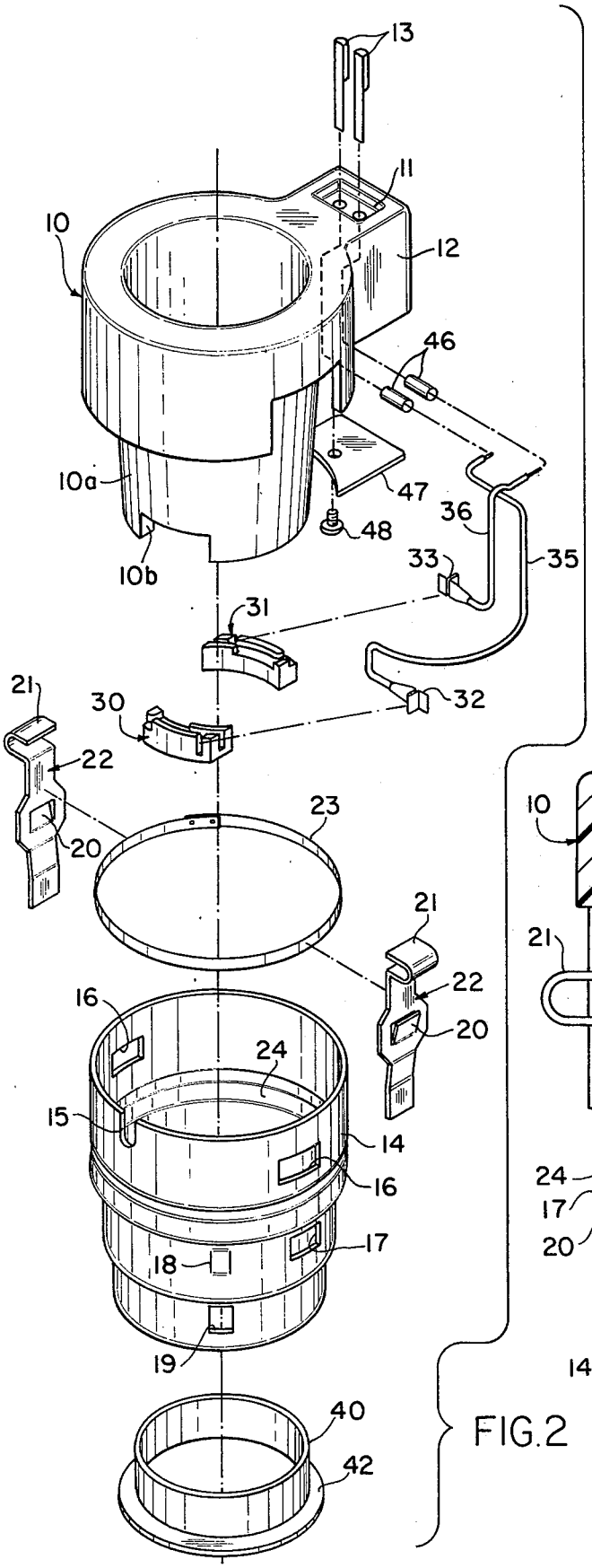
FIG. 2 is a perspective view of the adapter in its disassembled state.
Figure 1:
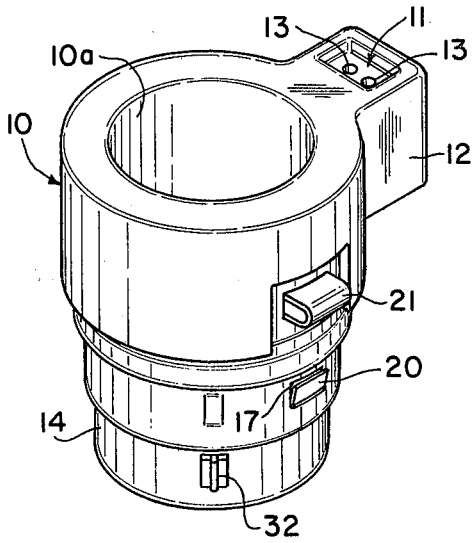
FIG. 1 is a perspective view of a vacuum cleaner hose end adapter according to the present invention.

Referring to FIG. 1, the vacuum cleaner hose end adapter comprises an upper housing 10 having an electrical receptacle 11 formed in an extension 12 thereof, the electrical receptacle 11 having a pair of electrical connectors 13 for receiving an electrical plug of a vacuum cleaner hose. As seen in FIG. 2, the upper housing 10 comprises an inner generally tapered cylindrical member **10*a* which is preferably integrally made with the upper housing portion 10, the two members preferably being integrally made of plastic material. The taper of portion 10*a*** is very small and is sufficient to accept a tapered wand or other connector of a vacuum cleaner hose with either a friction fit or an adhesively connected fit.

The adapter further comprises a lower, generally cylindrical, housing member 14, seen better in FIG. 2, which has a locating notch 15 in the upper end thereof and which further has cut-outs 16,17,18 and 19. Cut-outs 16 are provided in pairs, as are cut-outs 17, the second cut-out 17 not being seen in FIG. 2. The lower portion of the housing member 14 is of stepped construction and is adapted to be engaged in a receptacle or hose socket of a vacuum cleaner, such as the vacuum cleaner illustrated in U.S. Pat. No. 3,434,092. Engaging tabs 20 project from cut-outs or openings 17 to engage and lock the adapter in the vacuum cleaner receptacle, again as in U.S. Pat. No. 3,434,092. The projecting tab 20 is preferably integrally formed with a second manually operable projection 21 (located at opposite sides of the adapter) which may be squeezed inwardly by the operator to inwardly move projecting tabs 20 to release the adapter from the vacuum cleaner. The integral metallic member 22, from which projecting tab 20 and manually operable projection 21 are made, is best seen in FIG. 2. The metallic members 22 are retained in position interior of the housing member 14 by means of a ring or band 23 which engages the metallic members 22 and portions thereof indicated in FIG. 2 and which correspondingly is engaged in a cylindrical recess 24 formed in the housing member 14. The ring or band 23 is made of a relatively stiff, but resilient material so that it may be pressed in place and will tend to spring outwardly within the annular receptacle 24 to retain itself in place, as well as the metallic members 22. The band 23 has sufficient resiliency so that when the operating members 21 are depressed or pressed usually inwardly, the ring or band 23 yields with spring-like characteristics to permit the members 21 and projecting tabs 20 to move inwardly. The ring or band 23 will also bias the metallic members 22 in the outward direction when the operating members 21 are not depressed manually.

The device further comprises insulating contact supporting blocks 30,31 which have contact members 32,33 respectively mounted thereto and which project outwardly through cut-outs 19 on respective opposite sides of the adapter. The contacts 32,33 are mounted to insulating contact supporting members 30,31 via slots therein, as shown in FIG. 2. The contact supporting members 30,31 are retained in position by engaging in respective cut outs **10*b* of cylindrical housing member 10**.

The receptacle 11 comprises female electrical connecting elements 13 which are connected to respective lead wires 35,36, which lead wires have the connectors 32,33 respectively electrically connected to the opposite ends thereof. The lead wires 35,36 pass through spaces between the inner portion 10*a* of the upper housing and the lower housing member 14, as shown, for example in FIGS. 3–5. The contact members 32,33 fit into corresponding slots or openings in the contact blocks 30,31, the contact blocks retaining the contact members 32,33 in a fixed position within the lower housing member 14 so that they extend through the respective cut-outs 19 and do not electrically contact the lower housing member 14 which is generally made of a metallic material.

It is of utmost importance that the connector blocks 30,31 retain the contact members 32,33 in sufficiently fixed positions to prevent the contact members 32,33 from shorting out against the lower housing 14.

Figure 3:
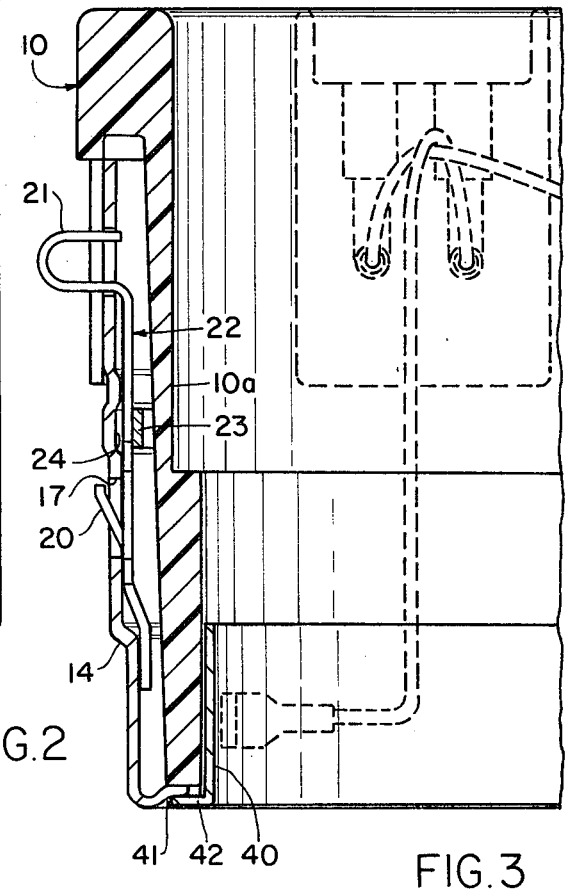
FIG. 3 is a sectional view taken along the line 3—3 in FIG. 5.
Figure 4:
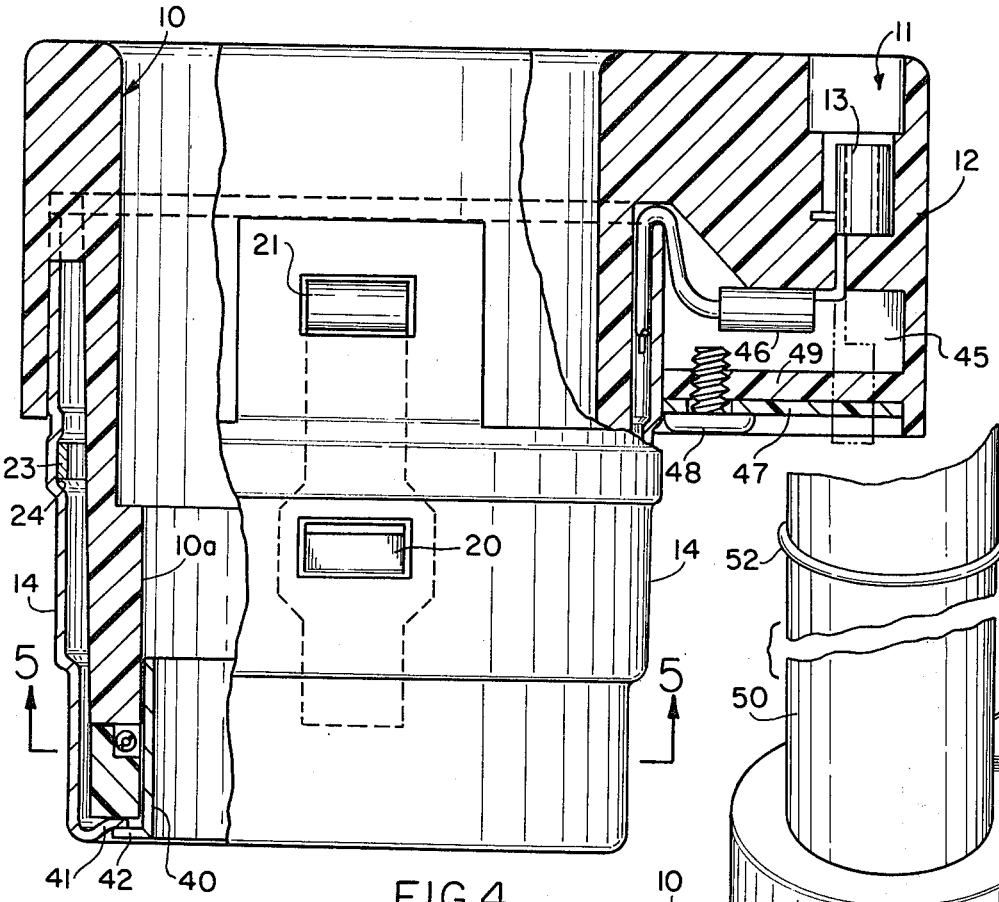
FIG. 4 is a side view of the vacuum cleaner hose end adapter, parts thereof being broken away to illustrate said parts in section.
Figure 5:
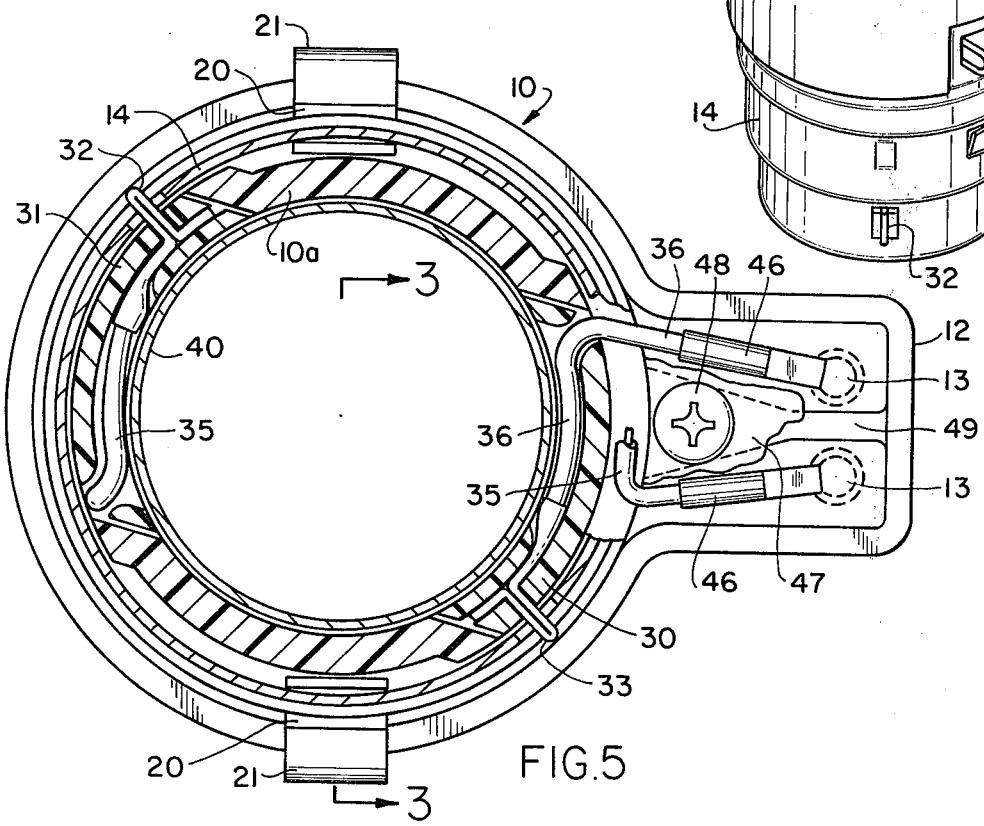
FIG. 5 is a sectional view taken along the line 5—5 in FIG. 4.

After assembly of the device, a lower cap member 40 is pressed into place to provide a finished appearance, for example as shown in FIGS. 3 and 4. The lower housing member 14 has a turned-up lower lip 41 which is received under the integral flange 42 of the bottom cap 40.

The portion 12 of the housing containing the female receptacle 11 has a lower space 45 within which the ends of the connectors 13 are connected to their respective lead wires 35,36. The connections may, if desired, then be insulated, for example by means of tape, insulating tubing, or the like 46. The space 45 is enclosed by means of, for example, a plate 47 and a screw 48 which threadably engages cross member 49 of the housing.

Figure 6:
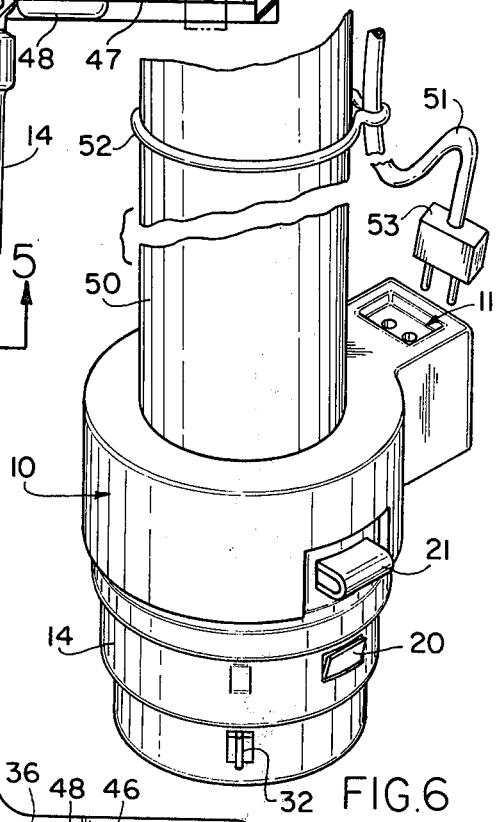
FIG. 6 illustrates how a vacuum cleaner hose is attached to the hose end adapter.

FIG. 6 illustrates the adapter of the present invention connected to a vacuum cleaner hose. The type of hose with which the adapter of the present invention is contemplated to be used generally comprises an elongated hose having a flexible portion, as in conventional vacuum cleaners. The hose has a substantially rigid end portion 50 which may be made of metal or plastic, and which is insertable into the housing of the adapter of the present invention, as shown in FIG. 6. The hose end 50 may be either press fit in the adapter, or may be secured in place by means of a suitable adhesive, such as white glue, epoxy, etc. The hose 50 has a power cord 51 extending therealong and preferably attached to the hose at intervals by means of clips 52, which may be metal or plastic, to retain the power cord 51 on the hose 50. The power cord 51 has a male plug 53 at the end thereof, similar to the male plug illustrated in FIG. 1 of U.S. Pat. No. 3,553,629. The male plug 53 is adapted to electrically connect with the receptacle 11 and to fit into the recess defined by receptacle 11. The other end of the power cord 51, at the opposite end of the vacuum cleaner hose is connected to an auxiliary device, such as a motor driven carpet cleaning device, shown for example in U.S. Pat. No. 4,018,493.

The power cord 51 may extend along the vacuum cleaner hose and may be connected thereto in any desired manner, or may be fabricated integral with the vacuum cleaner hose, as is known in the art. The main feature of the present invention is to provide a universal-type adapter unit which may be used with specific vacuum cleaners having electrical contacts mating with the electrical contacts 32,33 and to enable such specific vacuum cleaners to be used with conventional hoses having power cords with a plug, such as plug 53, at the end thereof to power a remote device, such as a motorized carpet cleaning device.

While the invention has been described with respect to specific embodiments, it should be clear that various modifications and alterations may be made within the scope of the invention, as defined by the appended claims.

I claim:

1. A vacuum cleaner hose end adapter for use with a vacuum cleaner having an electrified vacuum cleaner hose receptacle with electrical contacts therein, said adapter comprising:

a generally cylindrical housing which is substantially shorter than a hose of the vacuum cleaner, said housing having means at one end thereof for being received in and lockingly engaging the electrified vacuum cleaner hose receptacle, and means at the other end thereof for engaging a vacuum cleaner hose, said housing communicating suction developed in the vacuum cleaner to the hose engaged with said other end of said housing;

means at said other end of said housing defining a first electrical connector for receiving a mating electrical connector on a vacuum cleaner hose for supplying electrical energy to said mating electrical connector;

said housing comprising a double-walled generally cylindrical member having inner and outer walls, each of which is generally cylindrical and which are spaced from each other over at least a portion thereof;

a pair of electrical contact members at said one end of said housing, said pair of electrical contact members projecting outwardly of said outer wall of said housing at diametrically opposed side wall portions of said housing and being electrically insulated from said housing, and said electrical contact members being located so as to be received inside said vacuum cleaner hose receptacle when said one end of said housing is received in said hose receptacle to electrically contact mating electrical contacts within said vacuum cleaner hose receptacle;

at least one passage in said housing between said inner and outer walls thereof and extending from said electrical contact members to said first electrical connector, said inner wall of said housing preventing communication between said at least one passage and the interior of said generally cylindrical housing; and electrical conductors running within said at least one passage in said housing and electrically connecting the respective electrical contact members with said first electrical connector;

whereby electrical energy is supplied from a vacuum cleaner to said first electrical connector via said electrical contact members and said electrical conductors when said housing is received in said hose receptacle of the vacuum cleaner.

2. The vacuum cleaner hose end adapter of claim 1 wherein said first electrical connector is a female connector which is adapted to receive a mating male electrical connector for supplying electrical energy to said male electrical connector.

3. The vacuum cleaner hose end adapter of claim 1 or 2 wherein said first electrical connector is recessed in said adapter.

4. The vacuum cleaner hose end adapter of claim 1 or 3, comprising a pair of said passages in said housing between said inner and outer walls thereof and extending from respective electrical contact members to said first electrical connector, said passages respectively receiving one of said electrical conductors which electrically connect a respective electrical contact member with said first electrical connector, said inner wall of said housing preventing communication between both of said passages and the interior of said generally cylindrical housing.

5. The vacuum cleaner hose end adapter of claim 1 or 3, wherein said means defining said first electrical connector comprises a projecting housing portion which outwardly projects from the outer wall of said generally cylindrical housing and containing said first electrical connector therein, said at least one passage of said housing extending from said electrical contact members, between said inner and outer walls of said housing, and through an interior of said outwardly projecting housing portion such that said electrical conductors running within said at least one passage is not exposed to the exterior of said generally cylindrical housing or said outwardly projecting housing portion.

* * * * *